US009051767B2

(12) United States Patent
Nam

(10) Patent No.: US 9,051,767 B2
(45) Date of Patent: Jun. 9, 2015

(54) SLIDING DOOR DEVICE FOR MOTOR VEHICLE

(71) Applicant: HYUNDAI MOTOR COMPANY, Seoul (KR)

(72) Inventor: Kyunghyun Nam, Jeollabuk-do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 1 day.

(21) Appl. No.: 14/099,578

(22) Filed: Dec. 6, 2013

(65) Prior Publication Data

US 2014/0237898 A1 Aug. 28, 2014

(30) Foreign Application Priority Data

Feb. 27, 2013 (KR) ..... 10-2013-0021302

(51) Int. Cl.
*E05F 15/02* (2006.01)
*E05F 15/06* (2006.01)

(52) U.S. Cl.
CPC ..... *E05F 15/06* (2013.01); *E05Y 2900/506* (2013.01); *E05Y 2900/531* (2013.01); *E05F 15/42* (2015.01); *E05F 15/47* (2015.01); *E05F 15/565* (2015.01)

(58) Field of Classification Search
CPC ..... E05F 15/565; E05F 15/42; E05F 15/47; E05F 15/06; E05Y 2900/506; E05Y 2900/531; B60J 10/0037; B60J 10/0042; B60J 10/0091
USPC ..... 49/26, 27, 28, 409, 425, 477.1, 483.1, 49/366, 367, 368, 369, 370
See application file for complete search history.

(56) References Cited

U.S. PATENT DOCUMENTS

| | | | | | |
|---|---|---|---|---|---|
| 3,916,567 | A * | 11/1975 | Daugirdas | 49/28 |
| 4,773,183 | A * | 9/1988 | Okushima et al. | 49/28 |
| 5,728,984 | A * | 3/1998 | Miller | 200/61.43 |
| 6,125,591 | A * | 10/2000 | Schmidhuber et al. | 49/477.1 |
| 6,779,302 | B2 * | 8/2004 | Harrison et al. | 49/26 |
| 2014/0157670 | A1 * | 6/2014 | Nam | 49/28 |
| 2014/0157671 | A1 * | 6/2014 | Nam | 49/31 |

FOREIGN PATENT DOCUMENTS

| | | | |
|---|---|---|---|
| JP | 10-169316 | A | 6/1998 |
| JP | 3853958 | B2 | 9/2006 |
| KR | 10-1999-0051043 | A | 7/1999 |

* cited by examiner

*Primary Examiner* — Katherine Mitchell
*Assistant Examiner* — Catherine A Kelly
(74) *Attorney, Agent, or Firm* — McDermott Will & Emery LLP

(57) ABSTRACT

A sliding door device for a motor vehicle includes a slidably movable sliding door, a door weather strip attached to the sliding door, and a vehicle body weather strip tightly attached to the door weather strip to maintain airtightness in a state in which the sliding door is closed. A pressure switch senses an internal pressure of the door weather strip, and a pneumatic line connects the door weather strip and the pressure switch such that they communicate with each other. An electronic control unit (ECU) controls an opening and closing operation of the sliding door upon receiving a sensing signal from the pressure switch, and an opening and closing valve allows the pneumatic line to communicate with atmospheric pressure or closes the pneumatic line to atmospheric pressure. An object or a passenger is effectively prevented from being caught when a sliding door is being closed.

7 Claims, 5 Drawing Sheets

SLIDING DOOR DEVICE FOR MOTOR VEHICLE

CROSS-REFERENCE TO RELATED APPLICATION

This application claims the benefit of priority to Korean Patent Application No. 10-2013-0021302 filed in the Korean Intellectual Property Office on Feb. 27, 2013, the entire contents of which are incorporated herein by reference.

TECHNICAL FIELD

The present disclosure relates to a sliding door device for a vehicle, and more particularly, to a sliding door device for a vehicle capable of preventing an object or a passenger from being caught in a sliding door when the sliding door is closed.

BACKGROUND

In general, large commercial vehicles, such as buses and the like, employ a sliding door device to allow passengers to easily get on or get off.

The sliding door device includes a sliding door moving along a guiding rail provided in a vehicle in order to open and close a door opening formed in the vehicle. A pneumatic cylinder is a power source for moving the sliding door, and a microswitch senses closing of the sliding door. A controller is configured to control the pneumatic cylinder on the basis of a sensing signal from the microswitch to control an opening and closing operation of the sliding door.

The sliding door device also implements a sliding door safe closing function to prevent damaging an object or injuring a passenger when the object or the passenger is caught in a space between the sliding door and the door opening during a door closing operation in which the sliding door blocks the door opening.

When the object or passenger is caught in the space between the sliding door and the door opening while the sliding door is being closed, the sliding door safety closing function moves the sliding door in a reverse direction, i.e., in a direction in which the door opening is opened, thus preventing an object or a passenger from being caught.

The object or passenger caught in the sliding door is sensed by a pressure change within a door weather strip attached to cushion impact applied to the sliding door and secure airtightness. When the object or passenger is caught, a pressure is applied to the door weather strip to change the internal pressure, and such a change in the internal pressure of the door weather strip is sensed by a pressure switch so as to determine whether the object or passenger is caught.

However, in the related art, when the sliding door is closed, although objects such as the clothes of a passenger, bag straps, or the like, or a body part of a passenger is caught in the sliding door, they are disregarded in a certain section immediately before the sliding door is completely closed, e.g., in a section up to 30 mm wide immediately before the sliding door is completely closed. The closing operation of the sliding door continues in order to prevent malfunction due to compression of the door weather strip, thereby damaging the object or inflicting an injury on the passenger.

On a downhill slop, the sliding door is first closed by its own weight before the microswitch senses closing of the sliding door, generating a misdetection situation in which the microswitch cannot properly sense the closing of the sliding door. In order to prevent this, a point in time at which closing of the sliding door is recognized through the microswitch is set to be ahead of a predetermined interval, e.g., 30 mm from a point in time at which door is completely closed.

During the interval of 30 mm immediately before the sliding door is completely closed, although the object, such as the clothes of the passenger and the bag strap, or a body part of the passenger is caught in the sliding door, the closing operation of the sliding door continues and damages the object or inflicts an injury on the passenger.

When sensing the objects or the passenger caught in the sliding door, the internal pressure of the door weather strip may change according to a change in ambient temperature which causes a malfunction. Thus, the object or the passenger is determined to be caught only when the internal pressure of the door weather strip is equal to or higher than a predetermined pressure, e.g., 4.5 kgf.

A relatively small object having a size of, for example, 30×60 mm or less in thickness and width, or a small body part of a passenger is caught in the sliding door, would not be sensed due to low pressure, and thus, the closing operation of the sliding door continues and damages the object or inflicts injury on the passenger. Further, if the vehicle is running with the passenger caught in the sliding door, an accident may occur.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a sliding door device for a motor vehicle having the advantage of preventing accidents caused by a closing operation of a sliding door when an object or a passenger is caught between the sliding door and a door opening of a vehicle while the sliding door is being closed.

According to an exemplary embodiment of the present disclosure, a sliding door device for a motor vehicle includes a slidably movable sliding door, a door weather strip attached to the sliding door, and a vehicle body weather strip tightly attached to the door weather strip to maintain airtightness in a state in which the sliding door is closed. A pressure switch senses an internal pressure of the door weather strip, and a pneumatic line connects the door weather strip and the pressure switch such that they communicate with each other. An electronic control unit (ECU) is configured to control an opening and closing operation of the sliding door upon receiving a sensing signal from the pressure switch, and an opening and closing valve allows the pneumatic line to communicate with atmospheric pressure or closes the pneumatic line to atmospheric pressure.

The opening and closing valve may allow the pneumatic line to communicate with atmospheric pressure when the sliding door is opened and close the pneumatic line to atmospheric pressure when the sliding door is closed. The opening and closing valve may include a solenoid valve of which ON or OFF operation is controlled by the electronic control unit.

The sliding door device may further include a microswitch sensing closing of the sliding door, wherein when several seconds has elapsed after the electronic control unit senses a completion of closing of the sliding door via the microswitch, the electronic control unit may control the sliding door to not open.

The door weather strip may include a base portion inserted into the holder, and an elastic sealing portion integrally extending from the base portion in a width direction of the sliding door, and having a closed hollow section. A pressure sensing portion integrally extending further outward relative to the elastic sealing portion from the base portion in the width direction of the sliding door has a closed hollow section and is connected to the pressure switch through the pneumatic line.

The vehicle body weather strip may include a base portion installed in the door opening formed in the vehicle body. An elastic sealing portion integrally extending from the base portion toward the interior of the door opening has a closed hollow section therein, and is attached to the elastic sealing portion of the door weather strip in a state in which the sliding door is closed. A gap maintaining portion is defined to maintain a predetermined gap with respect to the door weather strip in a state in which the sliding door is closed.

The gap maintaining portion may be flat in the width direction of the vehicle body weather strip.

The electronic control unit may sense a change in the internal pressure of the pressure sensing portion of the door weather strip through the pressure switch, and when the internal pressure is higher than a predetermined pressure level, the electronic control unit may open the sliding door.

The sliding door device may further include a pneumatic cylinder as a power source for moving the sliding door, an operational link connecting the pneumatic cylinder and the sliding door to transfer an operating force from the pneumatic cylinder to the sliding door, and a guide rail guiding the sliding door.

The sliding door device for a motor vehicle according to an embodiment of the present disclosure, an object or a passenger can be effectively prevented from being caught in a sliding door when the sliding door is being closed.

Even when a narrow, thin object is caught in the sliding door, it can be easily extracted to be removed, thus preventing damage to the object or an injury to a passenger.

Since a sensing capability of sensing whether an object or a passenger is caught in a sliding door is enhanced, operational stability and marketability can be improved.

DETAILED DESCRIPTION

Hereinafter, embodiments of the present disclosure will be described in detail with reference to the accompanying drawings.

Figure 1:
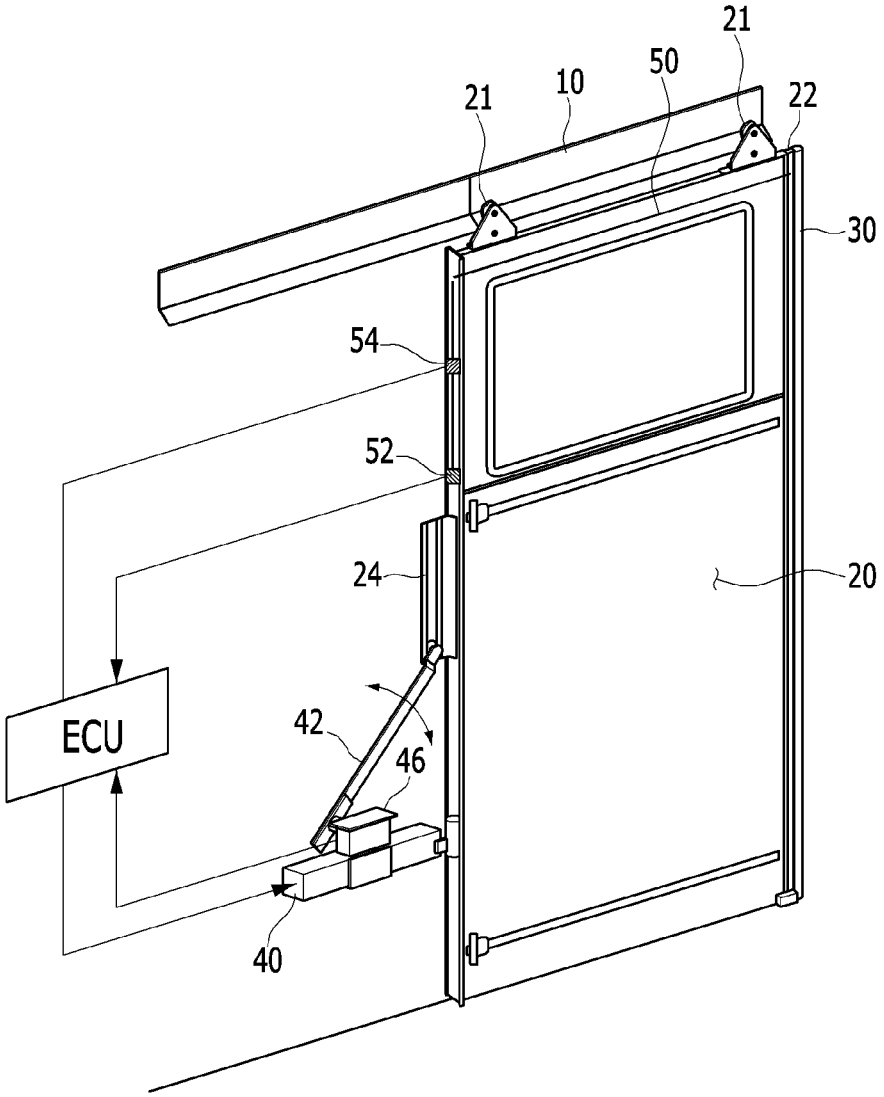
FIG. 1 is a view illustrating a configuration of a sliding door for a motor vehicle according to an embodiment of the present disclosure.

Referring to FIG. 1, a sliding door device for a motor vehicle according to an embodiment of the present disclosure includes a sliding door 20 slidably movable along a guide rail 10 installed on a vehicle body.

The guide rail 10 includes a cross-section having an 1' shape and extends in a length direction of the vehicle.

Two rollers 21 are installed at an upper portion of the sliding door 20. In a state in which the two rollers 21 are installed at the guide rail 10, the two rollers 21 are guided and moved along the guide rail 10 according to a predetermined track.

The sliding door has a substantially rectangular panel shape.

In FIG. 1, the sliding door 20 is in a state of closing a door opening (not shown) formed in the vehicle body. A door weather strip 22 is attached to one edge of the sliding door 20 in a length direction of the sliding door 20. Also, a vehicle body weather strip 30 is attached to the edge of the door opening of the vehicle body such that it corresponds to the door weather strip 22 of the sliding door 20.

The sliding door 20 slides to close the door opening of the vehicle body, and the door weather strip 22 and the vehicle body weather strip 30 are tightly attached to maintain the vehicle interior in an airtight state.

A pneumatic cylinder 40 is used as a power source for moving the sliding door 20. The pneumatic cylinder 40 may be installed on the vehicle body.

Besides the pneumatic cylinder 40, other power sources such as a hydraulic cylinder, or the like, may also be used.

The pneumatic cylinder 40 is connected to the sliding door 20 through an operational link 42.

A guide bracket 24 installed on another edge of the sliding door 20 in the length direction allows the operational link 42 to be inserted and moved therein.

The operational link 42 is installed to be rotatable based on a rotation axis. When the pneumatic cylinder 40 moves forward or backward, the operational link 42, making a rotational motion based on the rotation axis upon receiving motion and force from the pneumatic cylinder 40, pulls or pushes the sliding door 20 to slide.

In order to sense an internal pressure of the door weather strip 22, a pneumatic line 50 communicates with the interior of the door weather strip 22, and a pressure switch 52 is installed on the pneumatic line 50.

When the internal pressure of the door weather strip 22 changes according to a change in a shape or volume thereof due to an external force applied thereto, the pressure switch 52 senses the change of the internal pressure of the door weather strip 22 through the pneumatic line 50.

The pressure switch 52 may be switched when the internal pressure of the door weather strip 22 is, for example, 1.0±0.5 kgf per unit area. In order to input a corresponding switching signal to an electronic control unit (ECU), the pressure switch 52 may be connected to the electronic control unit.

The internal pressure of the door weather strip 22 may be changed by other external factors. For example, a temperature of the door weather strip 22 may be increased to increase the internal temperature and pressure of the door weather strip 22.

Here, the pressure switch 52 may input a misdetection signal resulting from the increase in the internal pressure of the door weather strip 22 according to ambient temperature change to the ECU. In order to prevent this, an opening and closing valve 54 is installed in the pneumatic line 50. The opening and closing valve 54 may be a solenoid valve. An ON or OFF operation of the opening and closing valve 54 may be controlled according to a control signal from the ECU.

When the sliding door 20 is operated to be opened, the opening and closing valve 54 may be turned on to open the pneumatic line 50, and accordingly, the interior of the door weather strip 22 communicates with atmospheric pressure so as to be maintained at atmospheric pressure. Thereby, a malfunction of the pressure switch 52 due to the temperature and pressure increase of the door weather strip 22 according to the ambient temperature change can be prevented.

When the sliding door 20 is closed, the opening and closing valve 54 is turned off, and the pneumatic line 50 is blocked to atmospheric pressure, maintaining airtightness, and thus, the change in the internal pressure of the door weather strip 22 can be checked by the pressure switch 52.

When an object or a passenger is caught between the sliding door 20 and the door opening while the sliding door 20 is being closed, the door weather strip 22 is compressed by the object or the passenger, increasing the internal pressure of the door weather strip 22.

For example, when the internal pressure of the door weather strip 222 is increased to be equal to or more than 1.0 kgf per unit area, the pressure switch 52 inputs a signal to the ECU. Upon receiving the switching signal from the pressure switch 52, the ECU controls the pneumatic cylinder 40 to operate the sliding door 20 such that it opens the door opening, thereby preventing the object or passenger from being caught while the sliding door 20 is being closed.

A microswitch 46 sensing closing of the sliding door 20 is disposed on the pneumatic cylinder 40. The microswitch 46 may indirectly sense closing of the sliding door 20 by a rotation amount of the operational link 42 or a stroke of the pneumatic cylinder 40.

When the passenger or object is not caught in the course of the closing operation of the sliding door 20, and the closing operation is completed, the microswitch 46 inputs a signal to the ECU. The ECU determines whether the sliding door 20 is completely closed on the basis of the input signal from the microswitch 46.

In a state in which the ECU determines the completion of the closing of the sliding door 20 on the basis of the input signal from the microswitch 46, when the switching signal from the pressure switch 52 is input after the lapse of a predetermined time, e.g., several seconds, the ECU disregards the switching signal from the pressure switch 52 and does not open the sliding door 20.

The internal pressure of the door weather strip 22 may be increased as the temperature is increased while the vehicle is running or stopped, and in this state, the sliding door 20 is prevented from being opened.

Figure 2:
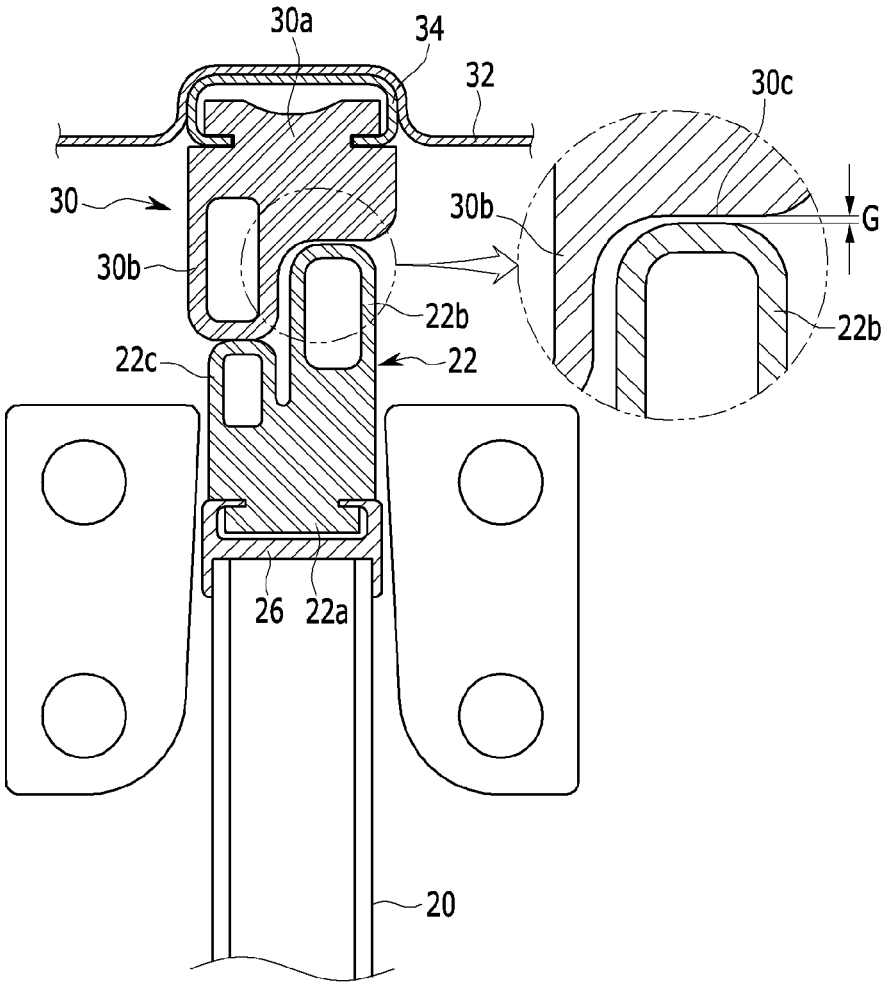
FIG. 2 is a cross-sectional view of a door weather strip and a vehicle body weather strip according to an embodiment of the present disclosure.

Referring to FIG. 2, cross-sections of the door weather strip 22 and the vehicle body weather strip 30 are illustrated. The door weather strip 22 is fixed to one edge of the sliding door 20 by a fixing unit such as a bracket or a holder 26.

The door weather strip 22 includes a base portion 22*a* inserted in the holder 26, a pressure sensing portion 22*b* integrally extending from the base portion 22*a* and having a closed hollow section, and an elastic sealing portion 22*c* integrally extending from the base portion 22*a* and having a closed hollow section.

The pressure sensing portion 22*b* may extend further outwardly in a width direction of the sliding door 20, relative to the elastic sealing portion 22*c*. The pressure sensing portion 22*b* is connected to communicate with the pressure switch 52 through the pneumatic line 50.

The vehicle body weather strip 30 is fixedly attached to the edge of the door opening formed in the vehicle body 32 by the medium of a holder 34. The vehicle body weather strip 30 includes a base portion 30*a* inserted into the holder 34, and an elastic sealing portion 30*b* integrally extending toward the interior of the door opening from the base portion 30*a* and having an internal closed hollow section.

When the sliding door 20 is closed to completely seal the door opening of the vehicle body weather strip 30, the elastic sealing portion 22*c* of the door weather strip 22 is tightly attached to the elastic sealing portion 30*b* of the vehicle body weather strip 30 and seals the interior of the vehicle interior.

The vehicle body weather strip 30 includes a gap maintaining portion 30*c* maintaining a predetermined gap G with respect to a front end surface of the pressure sensing portion 22*b* of the door weather strip 22 when the sliding door 20 is completely closed.

The gap maintaining portion 30*c* is formed to be substantially flat in the width direction of the vehicle body weather strip 30. The gap maintaining portion 30*c* prevents the door weather strip 22 from being pressurized by the vehicle weather strip 30 to increase the internal pressure of the door weather strip 22 when the sliding door 20 is completely closed.

The gap maintaining portion 30*c* of the vehicle body weather strip 30 and the pressure sensing portion 22*b* of the door weather strip 22 may maintain the gap G to be less than 30 mm.

Figure 3:
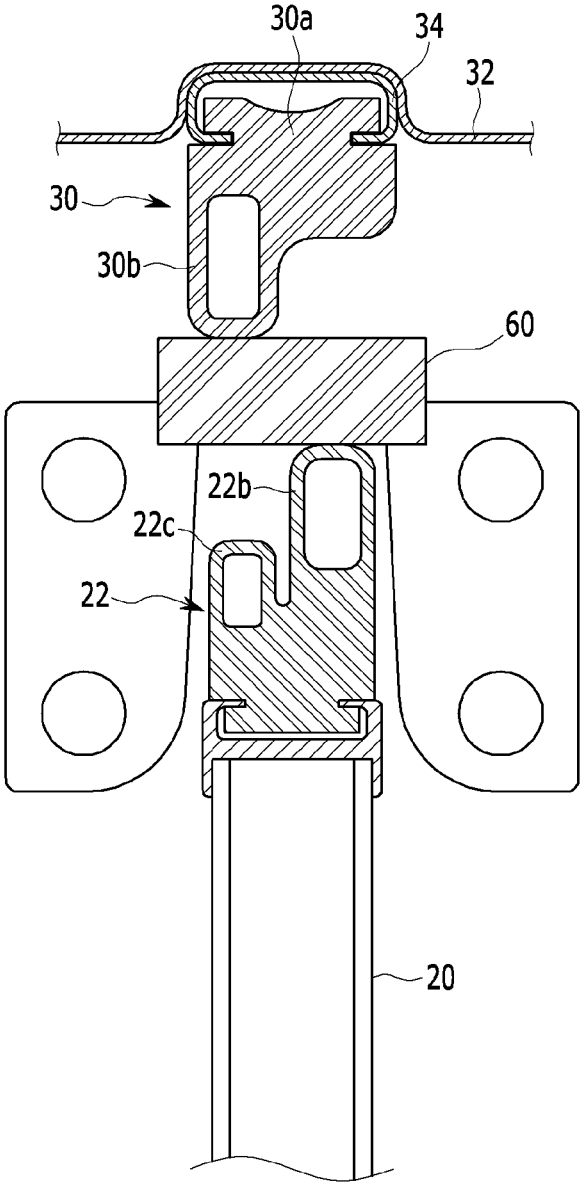
FIG. 3 is a cross-sectional view illustrating a state in which an object is caught between a door weather strip and a vehicle body weather strip while a sliding door is being closed according to an embodiment of the present disclosure.

Referring to FIG. 3, when an object 60 having a width of 30 mm or smaller or a body part of a passenger is caught, for example, between the door weather strip 22 of the sliding door 20 and the vehicle body weather strip 30 installed in the door opening of the vehicle body while the sliding door 20 is being closed, the object 60 is caught between the pressure sensing portion 22*b* of the door weather strip 22 and the elastic sealing portion 30*b* of the vehicle body weather strip 30. The pressure sensing portion 22*b* is pressurized by the object 60 so as to be deformed to change the internal pressure, and such a change in the pressure is sensed through the pressure switch 52.

The ECU operates the pneumatic cylinder 40 according to a sensing signal input through the pressure switch 52 to open the sliding door 20, thereby preventing the object 60 having a narrow width or a passenger from being caught while the sliding door 20 is being closed.

Figure 4:
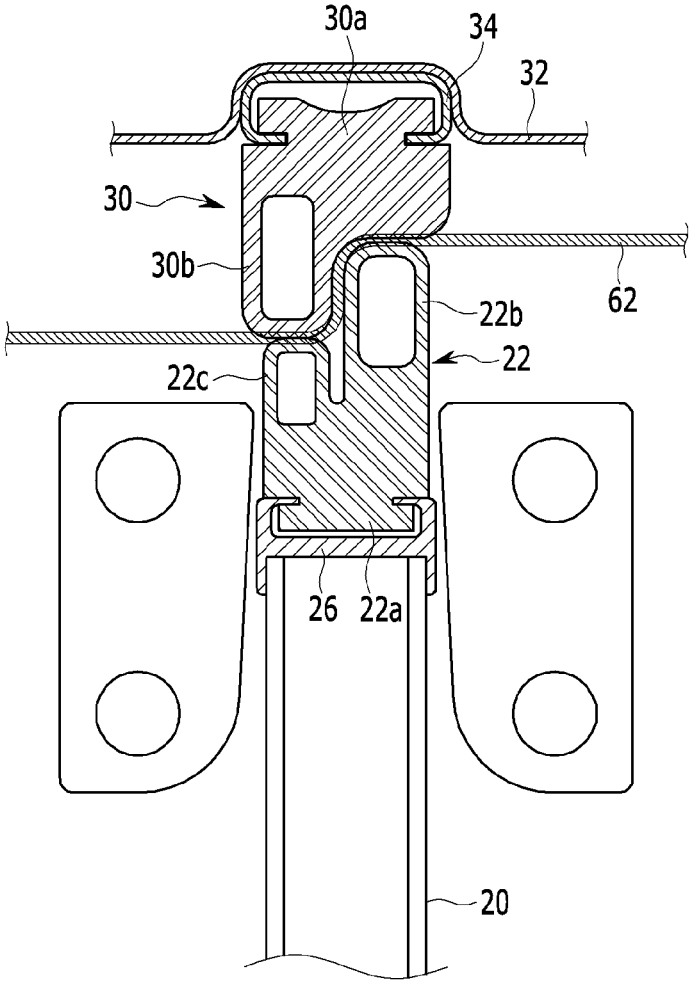
FIG. 4 is a cross-sectional view illustrating a state in which a thin object is caught between a door weather strip and a vehicle body weather strip while a sliding door is being closed according to an embodiment of the present disclosure.

Referring to FIG. 4, when a narrow, thin object 62, such as a strap of a bag or a strap of a handbag is caught between the door weather strip 22 of the sliding door 20 and the door opening of the vehicle body while the sliding door 20 is being closed or completely closed, the object 62 is disposed between the pressure sensing portion 22*b* of the door weather strip 22 and the gap maintaining portion 30*c* of the vehicle body weather strip 30, pressurizing the pressure sensing portion 22*b*. Then, the pressure sensing portion 22*b* is pressurized and deformed by the object 62 to change the internal pressure, which is sensed by the pressure switch 52.

The ECU operates the pneumatic cylinder 40 according to the sensing signal input through the pressure switch 52 to open the sliding door 20, thereby enhancing a sensing capability of an object being caught and eliminating a possibility of the thin object 62 being caught while the sliding door 20 is being closed.

Figure 5:
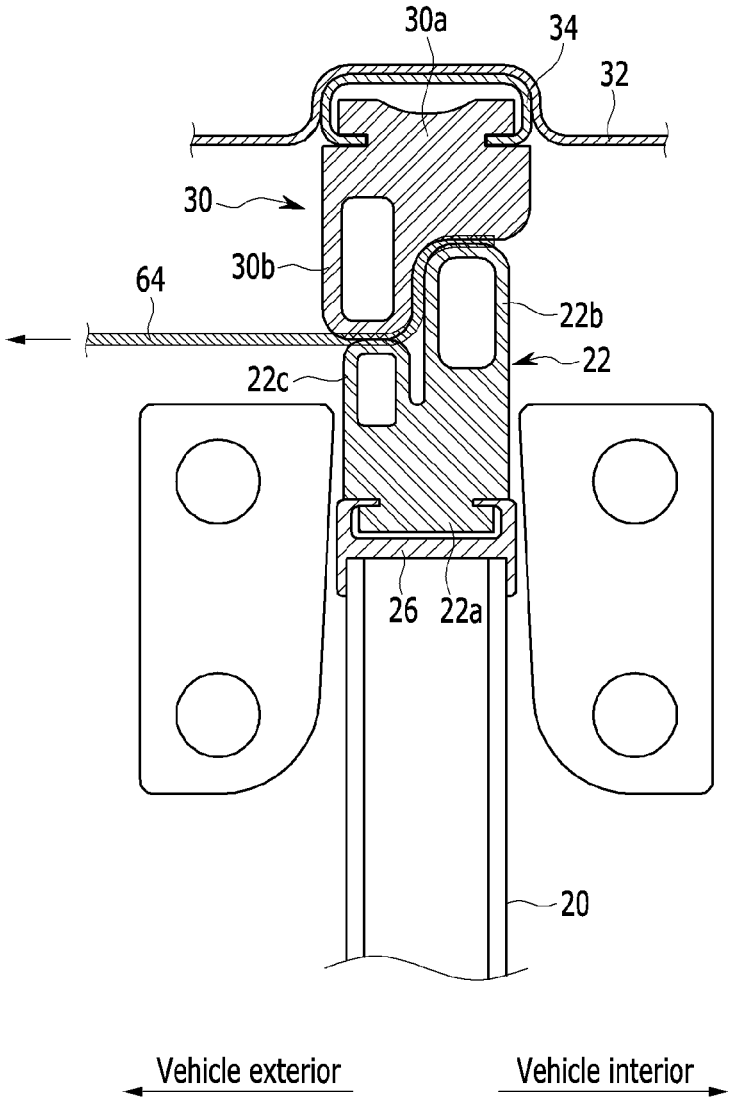
FIG. 5 is a cross-sectional view illustrating a state in which a thin object is caught between a door weather strip and a vehicle body weather strip while a sliding door is being closed according to an embodiment of the present disclosure.

Referring to FIG. 5, when a narrow, thin object 64, such as thin clothing, or the like, is caught between the door weather strip 22 of the sliding door 20 and the door opening of the vehicle body while the sliding door 20 is being closed or when the sliding door 20 is completely closed, the object 64 is pulled outward from the vehicle exterior as indicated by the arrow so as to be extracted. Then, the object 64 is easily released outward from the vehicle exterior between the door weather strip 22 and the vehicle body weather strip 30 due to matching characteristics of the door weather strip 22 and the vehicle body weather strip 22, thereby preventing an accident.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A sliding door device for a motor vehicle, comprising:

a slidably movable sliding door installed;

a door weather strip attached to the sliding door;

a vehicle body weather strip in contact with the door weather strip to maintain airtightness in a state in which the sliding door is closed;

a pressure switch sensing an internal pressure of the door weather strip;

a pneumatic line connecting the door weather strip and the pressure switch such that they communicate with each other;

an electronic control unit controlling an opening and closing operation of the sliding door upon receiving a sensing signal from the pressure switch; and an opening and closing valve allowing the pneumatic line to communicate with atmospheric pressure or closing the pneumatic line to atmospheric pressure, wherein the door weather strip comprises:

a first base portion inserted into a holder;

a first elastic sealing portion integrally extending from the first base portion in a width direction of the sliding door and having a closed hollow section; and a pressure sensing portion integrally extending, further outward relative to the first elastic sealing portion from the first base portion in the width direction of the sliding door, the pressure sensing portion having a closed hollow section, and connected to the pressure switch through the pneumatic line, and wherein the vehicle body weather strip comprises:

a second base portion installed at a door opening formed in a vehicle body;

a second elastic sealing portion integrally extending from the second base portion toward an interior of the door opening, having the closed hollow section therein, and in contact with to the first elastic sealing portion of the door weather strip in the state in which the sliding door is closed; and a gap maintaining portion defined to maintain a predetermined gap between the second base portion and the pressure sensing portion in the state in which the sliding door is closed.

2. The sliding door device of claim 1, wherein the opening and closing valve allows the pneumatic line to communicate with atmospheric pressure when the sliding door is opened and closes the pneumatic line to atmospheric pressure when the sliding door is closed.

3. The sliding door device of claim 1, wherein the opening and closing valve comprises a solenoid valve of which ON or OFF operation is controlled by the electronic control unit.

4. The sliding door device of claim 1, further comprising:

a microswitch sensing closing of the sliding door, wherein when several seconds has elapsed after the electronic control unit senses a completion of closing of the sliding door via the microswitch, the electronic control unit controls the sliding door to not open.

5. The sliding door device of claim 1, wherein the gap maintaining portion is flat in the width direction of the vehicle body weather strip.

6. The sliding door device of claim 1, wherein the electronic control unit senses a change in the internal pressure of the pressure sensing portion of the door weather strip through the pressure switch, and when the internal pressure is higher than a predetermined pressure level, the electronic control unit opens the sliding door.

7. The sliding door device of claim further comprising:

a pneumatic cylinder as a power source for moving the sliding door;

an operational link connecting the pneumatic cylinder and the sliding door to transfer an operating force from the pneumatic cylinder to the sliding door; and a guide rail guiding the sliding door.

* * * * *